United States Patent [19]

Düsch

[11] Patent Number: 4,569,297

[45] Date of Patent: Feb. 11, 1986

[54] NEEDLE BAR DETACHABLE DRIVE AND STROKE ADJUSTING MECHANISM

[75] Inventor: Albert Düsch, Kaiserslautern, Fed. Rep. of Germany

[73] Assignee: Pfaff Industriemaschinen GmbH, Fed. Rep. of Germany

[21] Appl. No.: 624,603

[22] Filed: Jun. 26, 1984

[30] Foreign Application Priority Data

Jul. 7, 1983 [DE] Fed. Rep. of Germany ..... 3324518

[51] Int. Cl.[4] ..... D05B 1/08; D05B 3/02

[52] U.S. Cl. ..... 112/221; 112/121.11; 112/276

[58] Field of Search ..... 112/121.24, 221, 163, 112/164, 165, 167, 98, 121.11, 274, DIG. 3, 276

[56] References Cited

U.S. PATENT DOCUMENTS

| | | | |
|---|---|---|---|
| 3,835,716 | 9/1974 | Ballamy | 112/221 X |
| 3,857,345 | 12/1974 | Higgins | 112/221 X |
| 3,881,432 | 5/1975 | Dodd et al. | 112/221 X |
| 3,913,508 | 10/1975 | Boser | 112/221 |
| 4,190,006 | 2/1980 | Mellor | 112/221 X |

FOREIGN PATENT DOCUMENTS

| | | | |
|---|---|---|---|
| 937504 | 12/1955 | Fed. Rep. of Germany . | |
| 1045756 | 6/1959 | Fed. Rep. of Germany . | |
| 780820 | 8/1957 | United Kingdom | 112/167 |
| 1374759 | 11/1974 | United Kingdom | 112/221 |
| 2053989 | 2/1981 | United Kingdom | 112/221 |

*Primary Examiner*—Werner H. Schroeder
*Assistant Examiner*—Andrew M. Falik
*Attorney, Agent, or Firm*—McGlew and Tuttle

[57] ABSTRACT

A drive mechanism for connecting a drive shaft of a sewing machine to a plurality of reciprocatable needle bars which are advantageously mounted in a single guide frame for reciprocation in the machine includes a link connection for each bar. The link connection includes an oscillatable two armed lever for each bar. It has an input arm driven by a shaft mounted in the machine for oscillation about a fixed axis and an output arm connected to a first link of a cooperative pivotally interconnected first and second link pair. An actuator shaft for each bar carries a respective actuator crank which in turn is connected through a link of relatively short length to the upper ends of the needle bars by a pivotal connection. The guide link is connected to the cooperative link pairs at their pivotal interconnection to each other and it may be moved by a setting mechanism which is either hydraulically or electrically actuated and is effective to change the reciprocation of each needle bar separately or together and without disconnecting the operating mechanism driving the needle bars.

8 Claims, 5 Drawing Figures

NEEDLE BAR DETACHABLE DRIVE AND STROKE ADJUSTING MECHANISM

FIELD AND BACKGROUND OF THE INVENTION

This invention relates in general to sewing machines and in particular to a new and useful drive mechanism for connecting a drive shaft of a sewing machine to one or more of a plurality of reciprocatable needle bars.

For sewing, embroidering or so-called tufting machines it is necessary to temporarily stop the needle bar or needle bars in reciprocation. For example, when sewing the corners of shirt collars on a two-needle sewing machine, one needle must be disconnected while continuing to sew with the second needle to the seam corner before the shirt collar is turned into the new sewing direction, around the inserted second needle. For obtaining seam interruptions, all needles must be disconnected. For shifting the embroidery frame from one pattern area to the next, also all needles of an embroidery machine must be disconnected, and in tufting machines, groups of needles are temporarily stopped to obtain tuft or color effects.

For the purpose of disconnection, the interposition of a clutch between the needle bar(s) and the drive is known (German Pat. No. 937,504, U.S. Pat. No. 2,868,152). If necessary, the needle bar is simply separated from its drive and retained in its upper dead center by a locking device. Since machines with clutch devices to be moved along have larger moved masses than machines without these disconnecting devices, and since the disconnecting occurs abruptly while the machine is running, the rotational speed of the machine is restricted to quite low limits if the inertia forces are not to become too high and if severe impacts and vibrations, or even breakage, of transmission parts are to be avoided.

Also very often the detachment of the needle bar from its drive causes errors in stitch formation after the needle bar is connected in again, and this leads, when sewing a corner on a shirt collar, to a deviation in the first stitch after the collar has been turned into the next sewing direction.

To avoid stitch errors after the needle bar has been reconnected, to obtain approximately the same quiet running of the machine with the needle bars connected or disconnected, to prevent strong impacts and vibrations as the needle bars are being separated from their drive, and hence to increase the rotational speed of the machine, there is known from German Pat. No. 1,045,756, (U.S. Pat. No. 2,824,532) an articulated drive to be switched on and off for a needle bar where the crank pin of the usual arm shaft crank is connected with the needle bar drive element by a link pair. The joint of the link pair is articulatedly connected by a connecting rod with a supporting link pivotable about an axle fast to the housing. For switching the articulated drive a double lever is used which is pivotable via an intermittent switching mechanism about a bolt fast to the housing and which comprises two lock teeth, of which the one snaps in the on position into a groove in a slidepiece and the other in the off position into a groove in the needle bar. In the on position, the drive movement is transmitted to the needle bar, and in the off position, it is transmitted to the connecting rod and the supporting link. Although one achieves thereby a relatively quiet run of the machine, the needle bar must, in this arrangement of the links, be mounted in slideways at the upper and lower ends, to be able to absorb the lateral forces acting on it. Because the links participate in the full needle bar stroke, the crank and needle bar pins are exposed to strong inertia forces, owing to which the rotational speed increase attainable as compared with the prior art drives with clutch between the needle bar and its drive is moderate. For modern high-speed sewing machines the arrangement known through German Pat. No. 1,045,756 is not suitable.

While in this device the stroke of the needle bar could be varied, this is not provided for in the patent. Besides, the needle bar lock in the disconnected position would then have to be eliminated. But the needle bar would then not stand still completely. Lastly it would be possible with this link arrangement to bring the needle bar always into the upper dead center of the maximum stroke for disconnection when sewing with a reduced stroke.

SUMMARY OF THE INVENTION

The invention provides a drive device for higher rotational speeds, for operation with less wear and noise, and for shock and impact free disconnection of the needle bar(s), which permits a sewing operation with adjustable needle bar stroke, and where in a disconnected position the upper dead center of the maximum needle bar stroke is provided and it is unnecessary to lock the needle bar in the disconnected position.

According to the invention, a drive device for disconnectable needle bars is provided where through the use of a link drive the needle bar is not exposed to lateral forces or is exposed to only very slight and hence negligible lateral forces, so that the mass of the needle bar or bars can be reduced and its suspension at both ends can be dispensed with in favor of a single bearing point. To change the needle bar stroke no gear parts need be exchanged, the disconnection of the needle bar or bars occurs completely shock and impact free. One can sew, e.g. with the smallest possible needle bar stroke or with another needle bar stroke adapted to the sewing material and sewing yarn, and the needle bar can, at the end of the seam, be brought into the upper dead center of the adjustable maximum stroke and be disconnected in so doing, so that for inserting and removing the sewing material the largest possible passage space under the needle is available. The possibility of bringing (the disconnected position) into the upper dead center of the maximum stroke of the needle bar or bars makes it possible, for instance in machines with a thread cutting device, to eliminate a back-turning device operating after the thread cutting process, by which the sewing machine, having been stopped for thread cutting with the thread lever in the up position, is turned back into the needle-high position after the thread has been cut. Since upon disconnection of the needle bar or bars, the mechanical locking of the drive device is not interrupted, no wrong stitch will be formed for example in the sewing of a corner of a shirt or blouse collar when the disconnected needle bar is reconnected after making the turn at the corner, as can happen with machines where the needle bar is disengaged from its drive for disconnection. Lastly, the disconnection and reconnection of the needle bar can be carried out in any desired position of the needle bar or bars or of the main shaft of the machine, while this is not possible with machines where the needle bar is separated from its drive device for disconnection.

Accordingly, it is an object of the invention to provide a sewing machine which includes a plurality of reciprocating needle bars with associated sewing needles with a drive mechanism which can be adjusted to selectively drive one or more of the needles without interrupting the others.

A further object of the invention is to provide a drive mechanism which is connectable between a rotating drive shaft which includes a linkage control system between the driving shaft and the reciprocating needle bars which may be selectively adjusted for each needle bar individually or all needle bars collectively so as to affect variations of the reciprocation and the stopping of selected ones as desired.

A further object of the invention is to provide a drive mechanism which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention are illustrated.

DESCRIPTION OF THE PREFERRED EMBODIMENT

Figure 1:
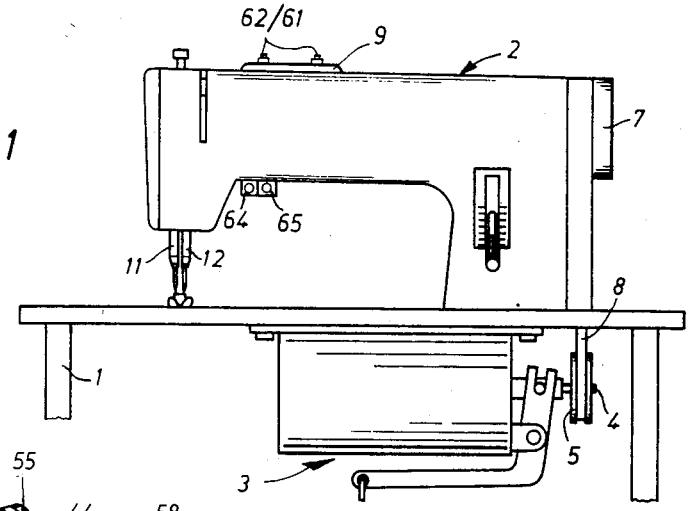
FIG. 1 shows a simplified side elevational overall view of a two-needle sewing machine inserted in a stand.

Referring to the drawings in particular the invention embodied therein, comprises a drive mechanism 10 for connecting a drive shaft or arm shaft 6 of a sewing machine to one or more of a plurality of reciprocatable needle bars 11, 12 which are mounted in a guide frame 17 for independent reciprocation. The drive mechanism 10 in accordance with the invention includes a link connection for each needle bar 11,12 and advantageously comprises an oscillatable two arm lever 22 for each bar which is driven by the arm shaft 6. The two armed lever 22 is mounted in the sewing machine for oscillation about a fixed axis 23 and it has an input arm portion 21 which is connected to the shaft by an eccentric rod 20 of an eccentric 19 carried by the shaft 6. A first link 26 is pivotally connected to an upward arm 24 and a second link 27 is pivotally connected to the first link 26 and together they form a cooperative link pair. An actuator shaft 32 and 39 is provided for each bar and each has a respective actuator crank arm 40 and 42. An actuator link 41 and 43 is pivotally connected to respective ends of the actuator crank arms 40 and 42. The links 41 and 43 are pivotally connected to the upper ends of the needle bars 11 and 12 respectively. In accordance with the invention, a guide link 47 is pivotally connected to the pivotal interconnection of the first link 26 and the second link 27 and it is movable by control means to effect changes in the reciprocation of the respective needle arms.

Into the machine stand marked 1, a sewing machine 2 is inserted, which is driven by a clutch motor 3 via a V-belt pulley 5 fastened on its output shaft 4, and a V-belt 8 tightened around the latter and a hand wheel 7 with a V-belt groove fastened on the arm shaft 6 (FIGS. 2 to 4) of the sewing machine.

The sewing machine housing has an enlarged area 9, in which the drive device generally designated by 10 for the needle bars 11,12 is arranged. At the lower end of the needle bars 11,12 a needle holder 13,14 for the thread-carrying needles 15,16 is attached. The needle bars 11,12 are mounted to be moved up and down in a guide frame 17, which is attached on a swinging shaft 18 mounted parallel to the arm shaft 6 in the machine housing.

The drive movement for the needle bars 11,12 is derived from an eccentric 19 which is fastened on the main shaft 6 of the machine and is embraced by an eccentric rod 20. The free end of the eccentric rod 20 is articulatedly connected with the cross-piece member 21 of a fork-shaped two-arm lever 22, which by means of bearing pins 23 is pivotably mounted in the machine housing and comprises the fork arms 24,25 acting as output arms.

The fork arm 24 is connected via an articulated link pair 26/27 with the use of joint pins 28,29,30 with a crank arm 31 which is fastened on an intermediate shaft 32 mounted in the machine housing parallel and in spaced relation to the main shaft 6 of the machine, and the fork arm 25 is connected via an articulated link pair 33/34 with the use of joint pins 35,36,37 with a crank arm 38 which is fastened on a sleeve 39 mounted on the intermediate shaft 32. The distance between the bearing pins 23 of lever 22 and the joint pins 28 and 35 at the fork arms 24 and 25 equals the distance between the joint pins 28,35 and the joint 29 or respectively 36 of the articulated link pair 26/27 or 33/34.

On the intermediate shaft 32 a crank arm 40 is fastened, whose free end is connected via an intermediate link 41 with the left needle bar 11, and the sleeve 39 carries a crank arm 42 whose free end engages at the right needle bar 12 via an intermediate link 43.

In this described design, no forces, or only negligibly small lateral forces, act on the needle bars 11, 12. Therefore, the needle bars 11,12 may be made of lighter metal and be mounted in the guide frame 17 in only one bearing bore; this contributes to increasing the rotational speed and reducing wear of the bearing.

Figure 2:
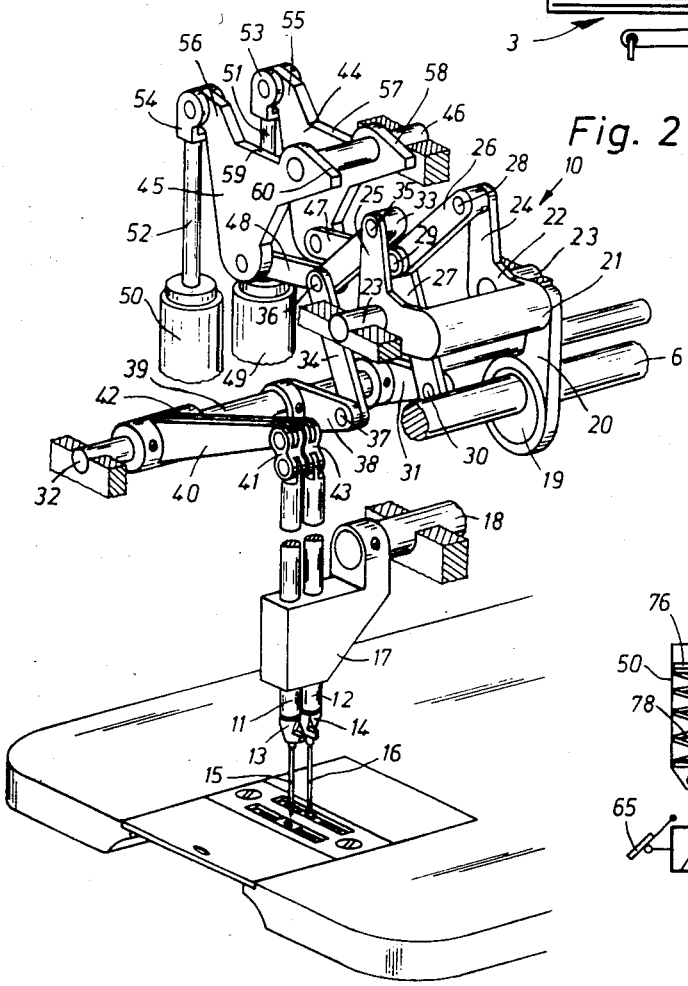
FIG. 2 is a perspective view of the essential transmission parts of the drive device for the two connected needle bars.
Figure 3:
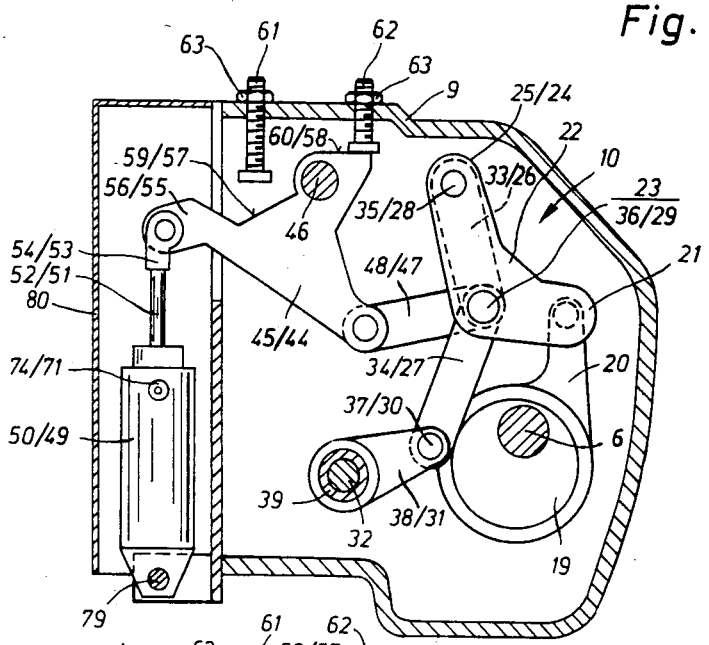
FIG. 3 is a side view of the link transmission with the switching means in the disconnected position of the needle bars, on a larger scale.

As can be seen in FIG. 2, the effective length of the crank arms 40 and 42 is double the length of the crank arms 31 and 38. Due to this lever transmission, only the intermediate links 41 and 43 at the crank arms 40,42 execute a swinging movement corresponding to the full stroke of the needle bars, while the other transmission parts (eccentric bar 20, lever 22, articulated links 26/27 and 33/34 as well as crank arms 31,38) execute a movement of smaller magnitude. This causes smaller inertia forces to occur as the machine runs, so that the rotational speed of the machine can be further increased.

The switching, or shifting means for the drive device 10 comprises two abutment plates 44, 45 which are pivotably arranged on a bearing stud 46 fastened in the machine housing and are in connection with the joint pin 29, 36 in the joint of the articulated link pairs 26/27 or 33/34 via a connecting rod 47,48 acting as guide link.

Two single-action pneumatic cylinders 49,50 have piston rods 51,52 which carry a fork head 53,54 engaging at a boom 55, 56 of the abutment plates 44, 45 and effect the pivoting of the plates.

To fix the on position and the off position for the needle bars 11, 12, the abutment plates 44, 45 have each two abutment surfaces 57,58 and 59,60 which cooperate with counter abutments 61,62 formed as screws in the machine housing. The position of the counter abutments 61,62 is fixable by a lock nut 63. To each abutment surface 57,59 a counter abutment 61 and to each abutment surface 58,60 a counter abutment 62 is correlated.

Figure 5:
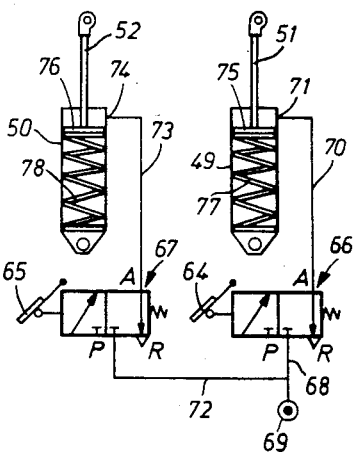
FIG. 5, is a schematic pneumatic switch plan.

The control of the pneumatic cylinders 49,50 occurs by actuation of switch keys 64,65 (FIGS. 1 and 5) via pneumatic valves 66,67 (FIG. 5).

The pump connection P of valve 66 is connected by a hose line 68 with a compressed air source 69 and is locked in the zero position of valve 66, while the operational connection A connected by a hose 70 with the connection 71 of the pneumatic cylinder 49 is vented via the return flow R of valve 66.

The pump connection P of valve 67 is connected by a hose line 72 to the hose line 68 and thus with the compressed air source 69 and is locked in the zero position of valve 67, while the operational connection A connected by a hose 73 with the connection 74 of the pneumatic cylinder 60 is vented via the return flow of valve 67.

Valve 66 is actuated for disconnection of the left needle bar 11 by the switch key 64, and valve 67 for disconnection of the right needle bar 12 by the switch key 65.

Instead of the mechanically actuated valves 66, 67 shown in the embodiment, electromagnetic valves may be used, the respective electric switches of which are switchable by actuation of the switch keys 64,65.

It should be mentioned also that the working pistons 75,76 of the pneumatic cylinders 49,50 are under the action of a compression spring 77, 78 and that the bottom of the cylinder housing is pivotably mounted on the machine housing by means of a bolt 79. Both pneumatic cylinders 49, 50 are covered by a cap 80.

Figure 4:
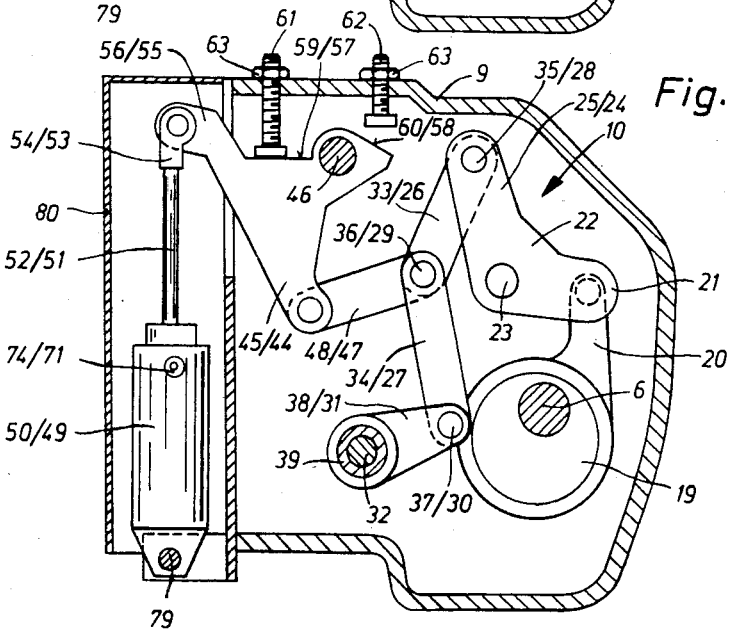
FIG. 4 is a view similar to FIG. 3 showing the connected position of the needle bars.

The mode of operation is as follows:

In operation, with the needle bars 11,12 connected according to FIGS. 2 and 4, the main shaft 6 of the sewing machine 2 is driven from the engaged clutch motor 3 via the V-belt pulley 5, the toothed belt 8, and the handwheel 7 fastened on the main shaft 6. By the eccentric 19 fastened on the main shaft 6, swinging movements are imparted to lever 22 via the eccentric rod 20, which movements are transmitted via the articulated link pair 26/27 connected with the output arm 24 of lever 22 and via the crank arm 31 to the swinging shaft 32, from which the left needle bar 11 is moved up and down via the crank arm 40 and the intermediate link 41. At the same time, via the articulated link pair 33/34 connected with the output arm 25 of lever 22 and via the crank arm 38, there are imparted to the sleeve 39 disposed coaxially to the swinging shaft 32 swinging movements by which the right needle bar 12 is moved up and down via the crank arm 42 and the intermediate link 43.

The thread carrying needles 15,16 fastened in the needle holders 13,14 of the needle bars 11,12 cooperate in known manner with loopers (not shown) for the formation of two seams independent of each other.

If for the formation of a corner seam of a shirt or blouse collar formed by two parallel seams the one, for example the right needle bar 12, is to be disconnected for interruption of the inner seam at the inner seam corner and is to be stopped in its upper dead center, while with the left needle bar 11 connected sewing is continued to the seam corner of the outer seam, the sewing machine is to be stopped there with the needle down, the work is to be rotated around the inserted needle 15 into the new seam direction, the outer seam is to be sewn to the level of the seam corner of the inner seam, the right needle bar 12 is to be reconnected there and sewing of both seams is to be continued, then it suffices to actuate the switch key 65, by which the pneumatic valve 67 is displaced into its switching position, in which the working piston 76 of the pneumatic cylinder 50 is pressurized from the compressed air source 69 via the hose line 72, the pump connections P and A of valve 67, the hose line 73 and the connection 74 and in so doing is pressed downward counter to the force of the compression spring 78. The abutment plate 45 is swiveled counter-clockwise about the bearing stud 46 by the piston rod 52 until the abutment surface 60 of the abutment plate 45 strikes against the counter-abutment 62 which determines the disconnected position of the right needle bar 12. With the swiveling of the abutment plate 45, the articulated link pair 33/34 is moved by the connecting rod 48 engaging in its joint 36 from the connected position per FIG. 4 into the disconnected position per FIG. 3. In this position, the longitudinal axes of the joint pin 36 of the articulated link pair 33/34 and the joint pin 23 of the lever 22 are in alignment and needle bar 12 is in its highest position. In this position of the transmission parts, link 33 executes pure back and forth rotary movements about the joint pin 36, so that no drive movements are transmitted to the needle bar 12.

For reconnection of the needle bar 12, valve 67 is switched into the zero position by spring force after release of switch key 65, the pneumatic cylinder 50 being vented via its connection 74, the hose line 73, the operational connection A and the return flow R of valve 67. The working piston 76 of the pneumatic cylinder 50 is then pushed upward by the compression spring 78 and thus the abutment plate 45 is swiveled clockwise about the bearing stud 46 into the connected position of the right needle bar 12 and brought to abutment with the abutment surface 59 on the counter abutment 61 which determines the connected position. With the swiveling of the abutment plate 45 the articulated link pair 33/34 is moved by the connecting rod 48 into the position per FIG. 4. The farther the joint pin 36 in the joint of the articulated link pair 33/34 moves away from the bearing pin 23 of lever 22, the greater will be the stroke of the needle bar 12. The transmission 10 is designed so that the position of the lower reversal point relative to the looper path or respectively to the stitch plate is maintained which position is important for the loop formation in the initial phase of the upward movement of each needle bar after passing through the lower reversal point. This results in the advantage that by displacement of the counter abutment 61 of a smaller needle bar stroke can be adjusted, if the work permits so that on the one hand one can sew at high rotational speed and on the other hand each needle bar is, when disconnecting, always pulled up into the upper dead center, which is determined by the abutment surface 58 or 60 and by the counter abutments 62. Owing to this, always the maximum possible space between needle and stitch plate is available for the insertion and removal of the work, and also the back turning device needed in sewing machines with thread cutter can be dispensed with.

The mode of operation for the disconnection and reconnection of the left needle bar 11 corresponds to that for switching the right needle bar 12, in that the switch key 64 is actuated and thereby, via the pneumatic valve 66, the pneumatic cylinder 49 is driven, whose piston rod 51, connected with its working piston 75, controls the abutment plate 44 and the articulated link pair 26/27.

As the mechanical positive drive connection is not interrupted during disconnection of the needle bars, no wrong stitch can form when the connection is restored.

With the described drive device 10, either the left or the right hand needle bar 11, 12 alone can be disconnected and reconnected or, for example in order to interrupt stitching in certain areas of a garment, both needle bars 11 and 12 can be jointly disconnected and reconnected.

While a specific embodiment of the invention has been shown and described in detail to illustrate the application of the principles of the invention, it will be understood that the invention may be embodied otherwise without departing from such principles.

What is claimed is:

1. A drive mechanism for connecting a drive shaft of a sewing machine to a plurality of needle bars which are mounted in sewing machines for selective independent reciprocation, comprising a link connection for each needle bar including an oscillatable two armed lever driven by the shaft and mounted in the machine for oscillation about a fixed axis and having an input arm driven by the shaft and having an output arm, a first link pivotally connected to said output arm, a second link pivotally connected to said first link forming with said first link a cooperative link pair, an actuator shaft for each bar, each having a respective actuator crank arm, an actuator link pivotally connected at its respective ends between said crank arm and a respective needle bar and a guide link pivotally connected to the pivotal connection between said first and second links.

2. A drive mechanism according to claim 1, including positioning means connected to said guide link moving said guide link to pivot said cooperative pairs into selectable operating positions.

3. A drive mechanism according to claim 2, wherein said positioning means includes an abutment plate pivotally mounted in said machine and pivotally connected to said guide link, and position abutment means adjacent said abutment plate engageable with said plate at selected operating positions for the needle bars.

4. A drive mechanism according to claim 2, wherein said positioning means includes a positioing member which is connected to said abutment plate for moving said plate to an adjusted position.

5. A drive mechanism according to claim 1, including a fixed axle rotatably supporting said actuator shafts including an actuator crank arm connected to one of said actuator shafts and to said second link of said cooperative link pair at the end thereof opposite to its connection to said first link, said positioning crank arm being of a length which is shorter than said crank arm connected to a said guide link for operating said needle bars.

6. A drive mechanism according to claim 1, including a fluid cylinder, a piston movable in said cylinder having a piston rod, a compression spring acting on said piston and urging it in an end position, an abutment member pivotally mounted in said sewing machine and pivotally connected to said guide link and having a pivotable connection to said piston rod, said compression spring urging said piston to move said piston rod with said abutment member into an end position and an adjustable abutment member mounted in said sewing machine engageable with said abutment member in the end position.

7. A drive mechanism according to claim 6, including an opposite end position, said abutment member having a second abutment portion and an adjustable stop abutment in said sewing machine engageable with said second abutment portion in an opposite end position of said piston, and means for pressurizing said cylinder for selectively positioning said piston and moving it in a direction opposite to the biasing direction of said spring.

8. In a sewing machine which includes at least two reciprocating needle bars, a rotary drive shaft, and a drive mechanism connecting between said rotary drive shaft and said needle bars, the improvement comprising, means effective when each needle bar is raised to its highest position at maximum stroke magnitude, for varying said drive mechanism for selectively changing the magnitude of the stroke during reciprocation of each needle bar, and for interrupting the drive of at least one of said needle bars when the one needle bar is at its top dead center position and while the other needle bar is still operating.

* * * * *